US005246086A

United States Patent [19]

Yunick

[11] Patent Number: 5,246,086

[45] Date of Patent: * Sep. 21, 1993

[54] OIL CHANGE SYSTEM AND METHOD

[76] Inventor: Henry Yunick, 957 N. Beach Rd., Daytona Beach, Fla. 32117

[ * ] Notice: The portion of the term of this patent subsequent to Dec. 10, 2008 has been disclaimed.

[21] Appl. No.: 669,913

[22] Filed: Mar. 15, 1991

Related U.S. Application Data

[63] Continuation-in-part of Ser. No. 659,992, Feb. 22, 1991, Pat. No. 5,079,831.

[51] Int. Cl.[5] ..... F16N 33/00

[52] U.S. Cl. ..... 184/1.5; 184/105.1; 184/105.3; 123/196 A; 123/196 R; 210/136

[58] Field of Search ..... 184/1.5, 6.3, 105.1, 184/105.3, 6.24; 123/196 S, 196 A, 196 R; 210/136, 168, 416.5

[56] References Cited

U.S. PATENT DOCUMENTS

| | | | |
|---|---|---|---|
| 2,002,165 | 5/1935 | Winslow | 184/6.24 |
| 2,566,354 | 9/1951 | Morey | 184/105.3 |
| 3,682,308 | 8/1972 | Moon | 210/136 |
| 4,094,293 | 6/1978 | Evans | 123/196 S |
| 4,359,140 | 11/1982 | Shreve | 184/6.3 |
| 4,388,185 | 6/1983 | Ott et al. | 123/196 A |
| 4,433,656 | 2/1984 | Norwood, Sr. | 123/196 A |
| 4,479,468 | 10/1984 | Norwood, Sr. | 123/196 S |
| 4,524,733 | 6/1985 | Schmidt | 123/196 A |
| 4,703,727 | 11/1987 | Cannon | 123/196 S |
| 4,825,826 | 5/1989 | Andres | 123/196 S |
| 4,865,156 | 9/1989 | Poling | 184/1.5 |
| 4,875,551 | 10/1989 | Lulich | 123/196 S |
| 4,909,205 | 3/1990 | Bewley, III | 123/196 S |
| 4,940,114 | 7/1990 | Albrecht | 184/6.3 |
| 4,964,373 | 10/1990 | Bedi | 184/1.5 |
| 5,000,143 | 3/1991 | Brown | 123/196 S |
| 5,044,334 | 9/1991 | Bedi | 184/1.5 |
| 5,070,831 | 12/1991 | Yunick | 184/6.3 |
| 5,145,033 | 9/1992 | Bedi et al. | 184/1.5 |

FOREIGN PATENT DOCUMENTS

| | | | |
|---|---|---|---|
| 0864982 | 2/1942 | France | 123/196 |

OTHER PUBLICATIONS

Pre-Luber Advertisement Sheet.

*Primary Examiner*—Ira S. Lazarus
*Assistant Examiner*—Alan B. Cariaso
*Attorney, Agent, or Firm*—Watts, Hoffman, Fisher & Heinke

[57] ABSTRACT

An internal combustion engine oil change system including an oil filter supplied with a check valve fill fitting. During an oil change, new oil is supplied to the engine through the check valve fitting, thus both filling the filter with oil and back flushing the engine's oil pump. An oil supply mechanism including a tank adapted to hold an appropriate pre-measured quantity of oil under air pressure is provided. A flexible hose with a quick disconnect female coupling connects the tank to the filter fitting for delivering oil from the tank through the filter into the engine. An alternative embodiment places the check valve fitting on a high pressure side of an oil supply conduit. Another embodiment places the check valve fitting on a loading ring located between the filter and the engine.

10 Claims, 5 Drawing Sheets

OIL CHANGE SYSTEM AND METHOD

This is a continuation-in-part of Ser. No. 07/659,992, filed Feb. 22, 1991, entitled "Oil Change System and Method," now U.S. Pat. No. 5,079,831, issued Dec. 10, 1991.

TECHNICAL FIELD

This invention relates to engine lubrication systems and more specifically, to an engine oil change system and method.

BACKGROUND

For a number of years, all automobile engines and virtually all, if not all internal combustion engines for other applications have been equipped with oil filters. These filters have a finite useful lives and must be changed from time to time to avoid excessive contamination of lubricating oil within an engine. Typically, the spent filter is replaced concurrently with an engine oil change.

When motor oil filters were first introduced, they were typically positioned with the inlet and outlet of the filter oriented upwardly. Such early filters were connected in oil lines communicating with oil passages in the engines and the engine's crank case or connected to the lower portion of the engine's block with an upward orientation. With such upward orientation, it was possible to fill an oil filter with some of the new oil about to be provided for an engine before the filter was connected to that engine.

With many current-day engines, it is no longer possible to prefill the filter before connection to the engine because the filters are oriented with their inlet and outlet openings facing downwardly. Thus, if one attempts to fill the filter with new oil before connecting it to the engine, the oil will pour out as one attempts to connect the filter to the engine.

When an engine is first started up after an oil change, the engine's oil pump and lubricating passages are substantially free of oil because the old oil has been drained from the engine. As such an engine starts the oil pump must self prime and then its output will flow first to the newly installed filter. Until sufficient oil output has been provided to fill the filter, the engine components requiring lubrication will be starved for lubricating oil. A period of the order of 10 to 20 seconds may elapse before oil under pressure is supplied throughout the engine's lubricating system and the wear parts which require lubrication are receiving adequate lubrication. Considerable engine wear can and does occur during this time.

Modern microprocessor controlled ignition systems exacerbate the problem. With a properly tuned microprocessor controlled ignition system, engine start-up is virtually instantaneous as contrasted with several seconds that would pass before even a well tuned engine of the precomputer controlled era would start. This start-up of oil-starved engines has caused a problem. Specifically, excessive engine damage is occurring because oil starvation is occurring.

Investigation has established that service stations which perform oil and filter change services, particularly those of the so-called ten-minute oil change type, are being forced to replace an excessive number of engines which have been severely damaged or destroyed by lack of adequate lubrication on start-up after an oil change. Indeed this investigation suggests auto dismantlers (once known as junkyards) have found a ready market for used engines in selling them to operators of ten-minute oil change facilities. Moreover, the investigation has also revealed that auto manufacturers are experiencing excessive warranty claims.

SUMMARY OF THE INVENTION

An engine lubrication system embodying the present invention comprises a pump and an oil conduit. The conduit defines a first pressure side for delivery of oil from the pump to engine parts requiring lubrication and a second lower pressure side for returning oil from the engine parts to the pump. The conduit comprises an oil filter having an inlet communicating with the pump, an outlet for discharging oil to the engine parts to be lubricated and a filter element through which the oil passes. The conduit further comprises a fill fitting for directing replacement oil into the first pressure side located along the conduit. The fitting comprises a fitting body, a fill passage extending through the body, a check valving member located in the passage, a valve seat located in the passage, and biasing means for biasing the check valving member in the valve seat.

An engine utilizing the present invention has its oil changed by first draining all of the used oil from the engine and removing a used oil filter from the engine. A new oil filter is mounted to the engine in place of the used oil filter. The new oil filter is filled by supplying new oil to the new filter by flowing oil through the check valve equipped fill fitting located along the pressure side of the oil supply conduit.

PREFERRED MODE OF THE INVENTION

Figure 1:
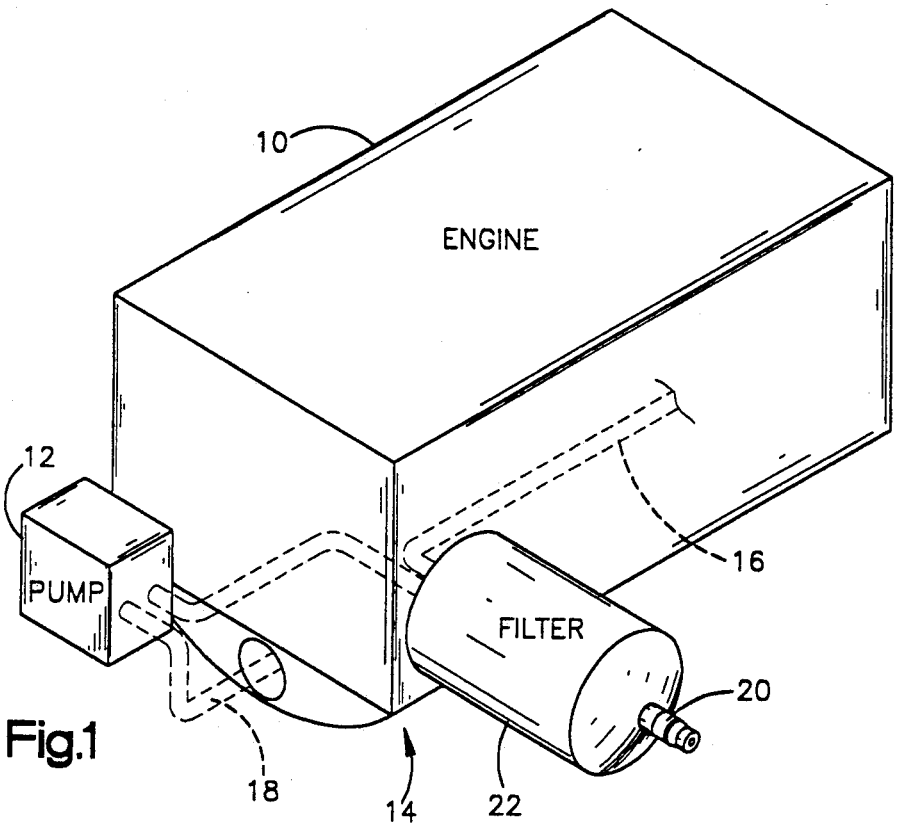
FIG. 1 is a schematic view of an engine equipped with an oil filter unit constructed according to this invention.
Figure 3:
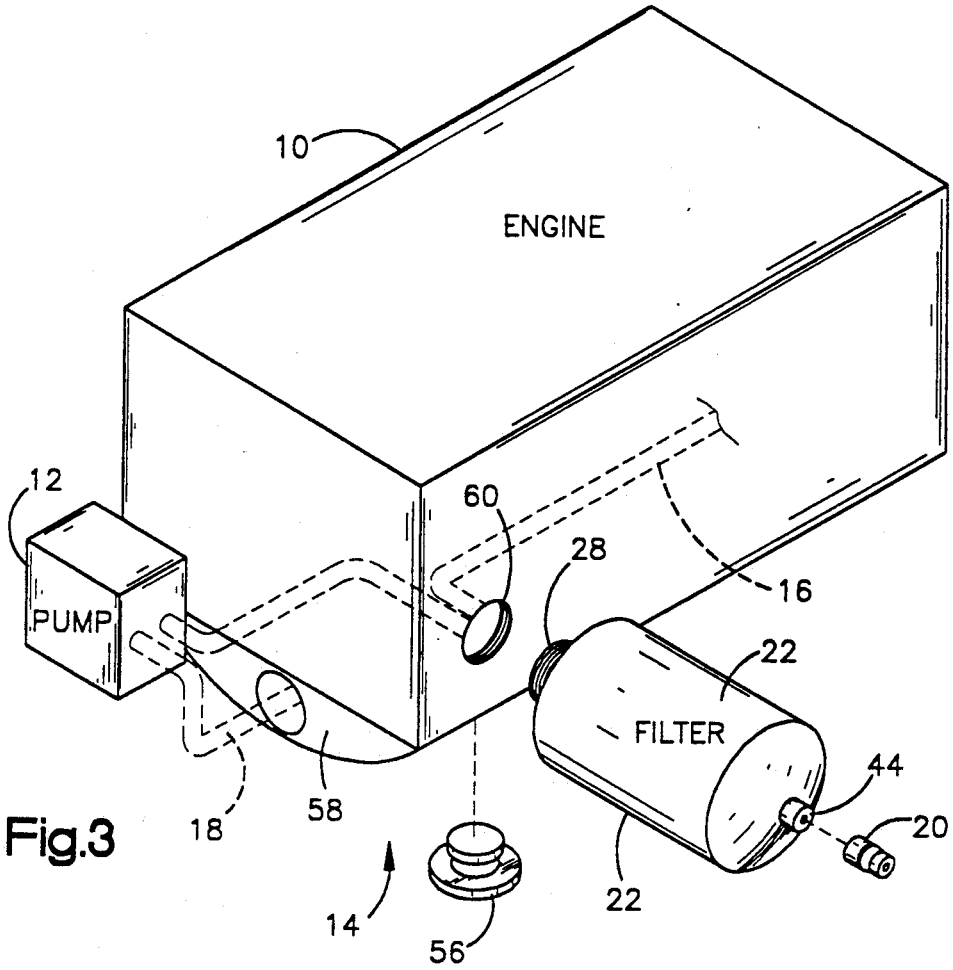
FIG. 3 is a schematic view similar to FIG. 1 showing the oil filter unit removed from the engine, the oil pan drain plug removed, and portions of the engine lubrication system which are schematically illustrated by broken lines.
Figure 4:
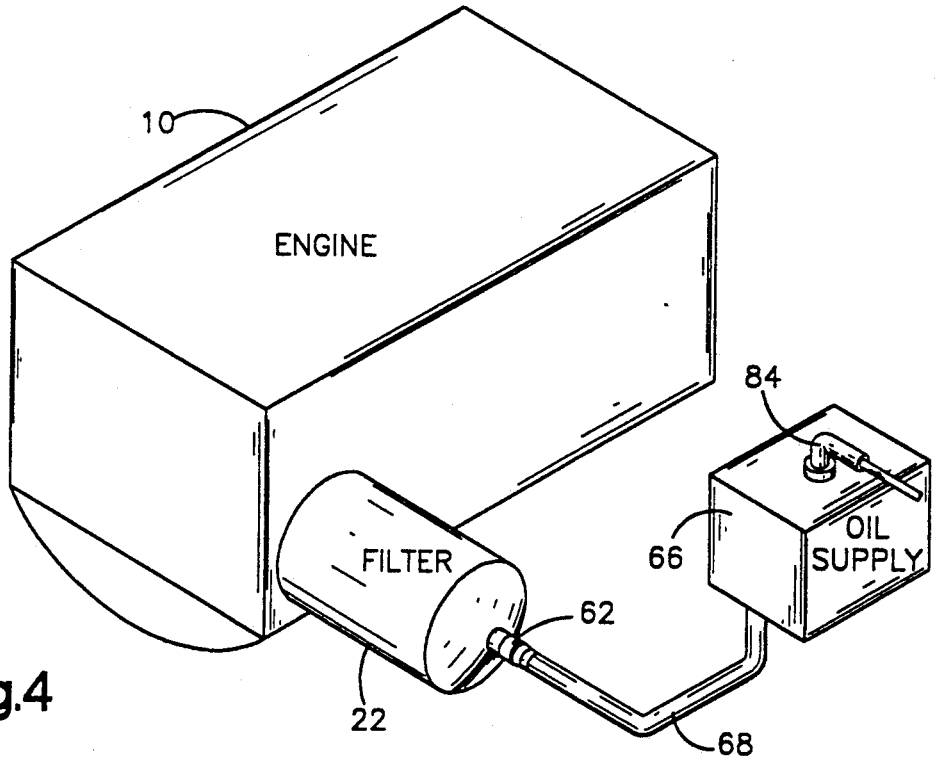
FIG. 4 is a schematic view showing replacement oil being added to an engine lubrication system which has been emptied of oil.

Referring now to the drawings, an engine having an internal lubrication system is shown schematically at 10 in FIGS. 1, 3 and 4. The lubrication system comprises an oil pump 12 supported with the engine block and an oil conduit 14 for receiving oil under pressure from the pump outlet channelling the oil to engine parts requiring lubrication and then returning the oil, at lower pressure to the pump inlet. The conduit 14 comprises a first pressure side 16 formed by various engine oil passageways and channels schematically shown for delivering oil from the pump 12 to the engine parts, a second lower pressure side 18 (schematically illustrated) comprising engine oil channels and passages by which oil returns to the pump inlet from the lubricated engine parts, in the high pressure side and a fill fitting 20 in the high pressure side through which lubricating oil is introduced into the system.

Figure 2:
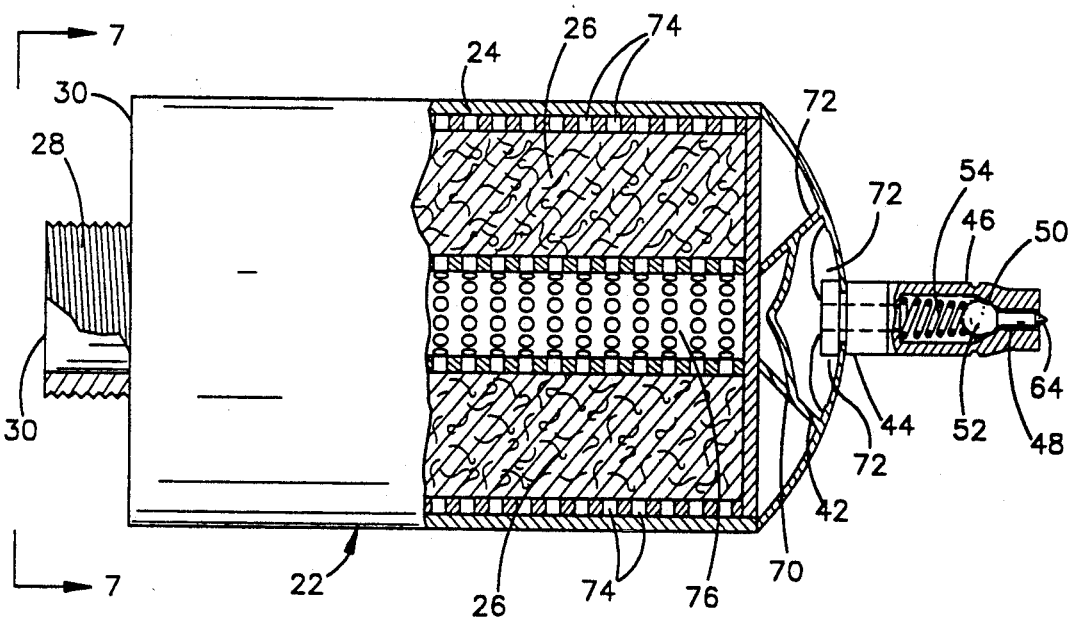
FIG. 2 is a side elevational view, on an enlarged scale, of the filter unit of FIG. 1 with parts illustrated in cross section.
Figure 7:
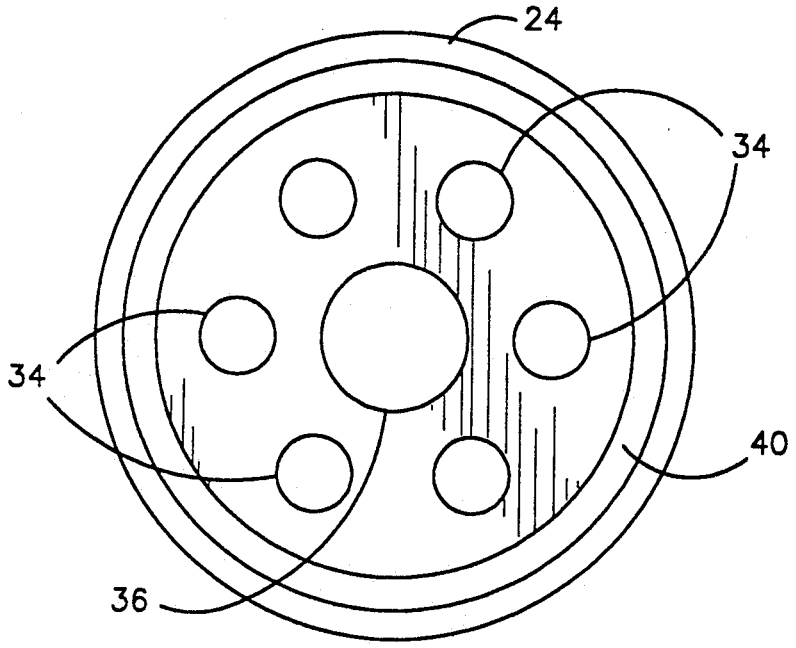
FIG. 7 is a view seen approximately from the plane indicated by the line 7—7 of FIG. 2.
Figure 8:
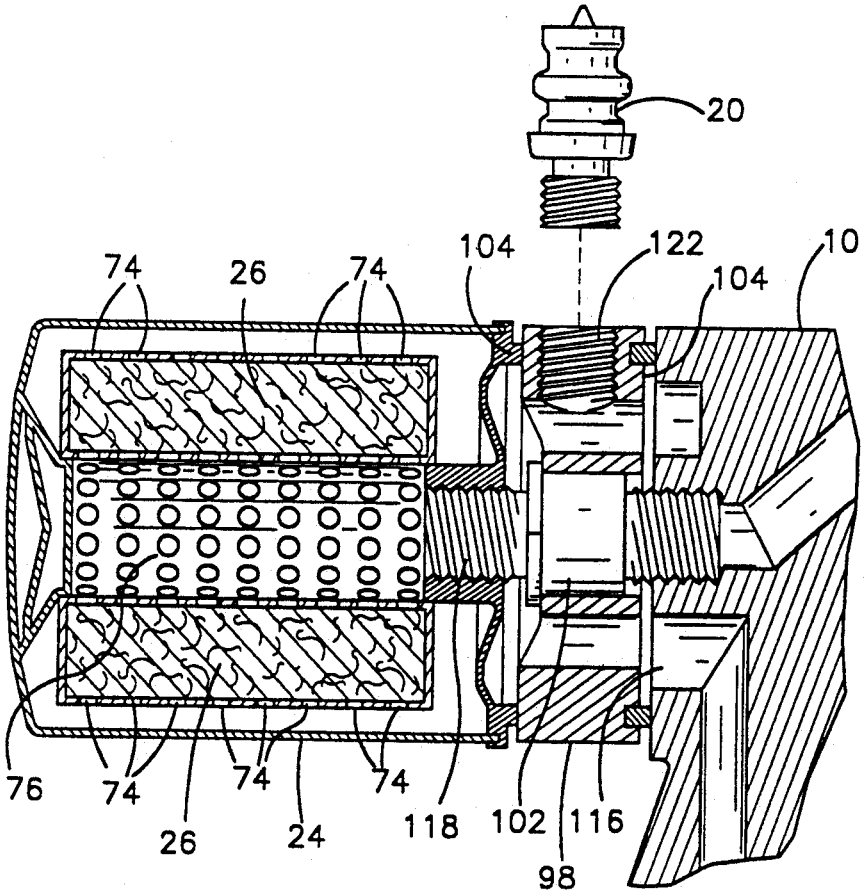
FIG. 8 is a cross sectional view of an oil filter unit, oil loading ring assembly and fill fitting forming an alternative embodiment of the present invention.
Figure 9:
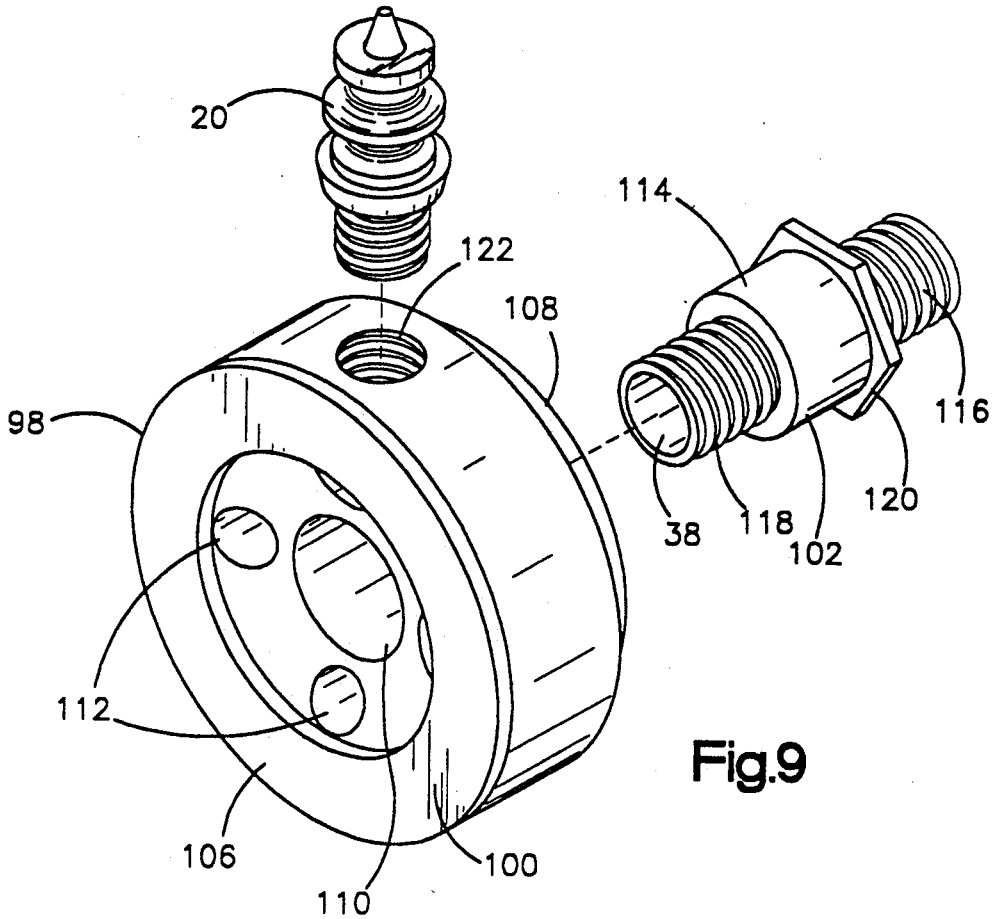
FIG. 9 is an exploded perspective view of the loading ring and fill fitting assembly illustrated in FIG. 8; and, FIG. 10 is an enlarged fragmentary cross sectional view of the fill fitting of FIG. 9.

An oil filter unit 22 illustrated by FIGS. 2 and 7 is constructed according to one preferred embodiment and includes a generally cylindrical housing 24 having an internal oil filter structure 26 and a tubular threaded mounting element 28 at a mounting end 30 of the filter housing 24 for connecting the housing to the engine 10. The filter mounting end has a plurality of circularly arranged oil inlet holes 34 and an oil outlet 36 located centrally among the oil inlet holes. The mounting element 28 is tubular having a through-passage 38 which functions to access the filter's oil outlet 36 when the filter is in use. A seal 40 is provided to form a fluid tight seal between the filter 22 and the engine 10 when the filter is mounted to the engine.

The filter housing 24 includes a dome-like closure 42 at its end remote from the mounting end 30. The closure 42 is imperforate except for a tapped fitting receiving element 44 which is heretically mounted in the closure and provides a central tapped opening through the dome. The fill fitting 20 is threadably connected to the fitting receiving element 44 in this particular embodiment. As seen in FIG. 2, the fill fitting 20 includes a fitting body 46, a fill passage 48 extending through the body, a valve seat 50 in the fill passage, a check valving member 52 and a biasing spring 54 for biasing the valving member 52 into sealing engagement with the seat 50 to normally close the fill passage 48. In short, the fill fitting 20 includes a check valve which permits oil to be introduced through the fitting. The fill fitting 20 is preferably a quick release fitting for a pneumatic hose and the body 46 is provided with an external detent face and an associated sealing surface for accommodating a hose fitting.

FIG. 3 schematically depicts the process of changing oil within the engine and the filter. To that end, a drain plug 56 has been removed from an oil pan 58 to allow the oil to be drained from the engine. The filter 22 has been removed from the engine by rotating it in the direction indicated by the arrow in FIG. 1 to disconnect the threaded mounting element 30 from a threaded aperture 60 in the engine block.

A check valve 20 has been removed from the filter unit 22 also by unthreading it. The operator then threadably connects the check valve 20 to a new filter unit 22 and in turn connects the filter unit by threading it into the engine aperture 60. The drain plug 56 is reconnected to the engine and the engine is prepared to receive new oil.

A quick disconnect female fitting 62 is connected to an appropriately sized male fitting portion 64 of the fitting 20. Oil is fed from an oil supply 66 through a hose 68 to the quick disconnect female fitting 62.

The filter 22 further includes filter structure 26. Within the dome-like closure 42, the filter 22 has an internal frusto-conical structure 70 for support. Gaps 72 are provided within the internal structure 70 to allow oil filled through the fill fitting 20 to reach filter structure 26 through a plurality of inlet holes 74 along its side. The filter structure 26 also has a plurality of exit holes 76 in communication with the filter's exit 36 thereby allowing the filtered oil to exit the filter structure 26 as well as the filter unit 22 itself.

Figure 5:
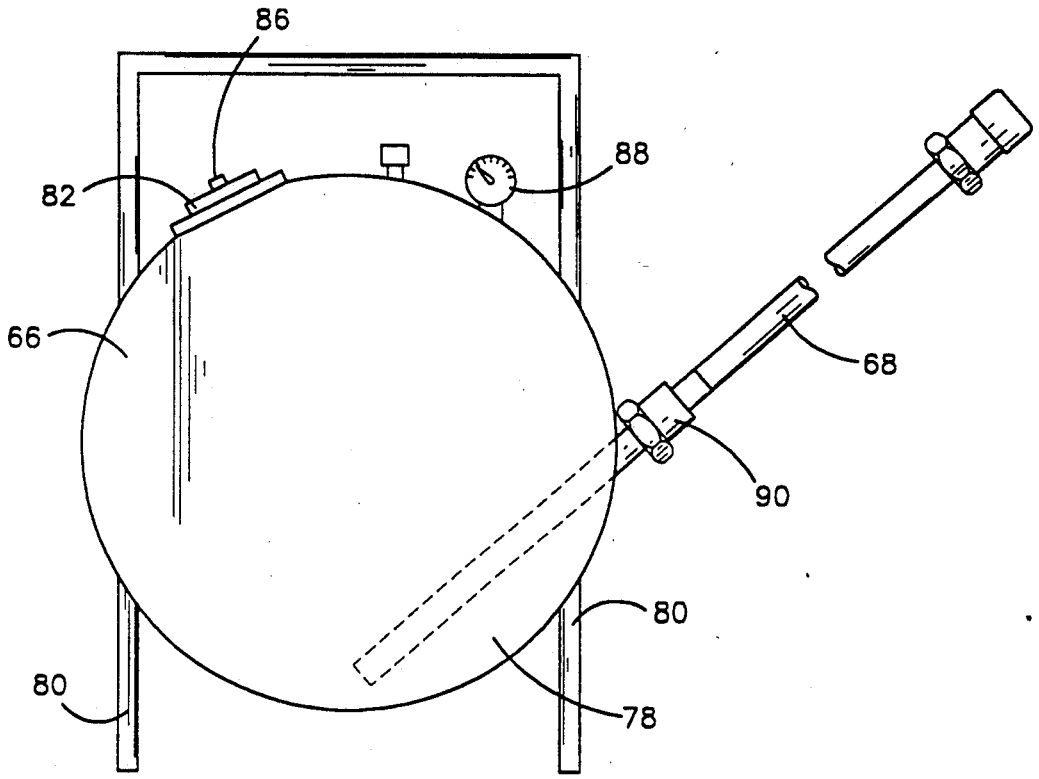
FIG. 5 is a view of an "oil gun" device used to supply new oil to the engine.

An oil supply for do-it-yourselfers and small garages is that shown in FIG. 5. Turning to FIG. 5, a tank 78 is provided. The tank 78 is supported by legs 80 for mounting on the floor of a garage or the like. The tank 78 has a fill opening 82 through which a pre-measured quantity of oil may be introduced. Once the fill opening 82 is closed, an air supply indicated schematically at 84 in FIG. 4 is connected to an air fitting 86, FIG. 5. Air is supplied to desired pressure as indicated on an air gauge 88. The quick disconnect female fitting 62 is connected to the filter. A valve 90 is then opened. The air pressure in the tank 78 forces oil through the supply hose 68 then through the filter 22 into the engine. Thus, the oil filter is filled before the engine is started up after an oil change. Moreover, standard internal connections of the engine will cause the oil to enter the crank case and concurrently reverse flush an oil pump. With this system, oil pressure will be supplied to the engine virtually instantaneously after start-up after an oil and filter change.

A further advantage of the invention is the ability to fill the filter 22 with oil regardless of the position of the filter. The drawings illustrate the filter 22 located at the side of the engine but many engines place the filter in other positions, including the top of the engine.

Figure 6:
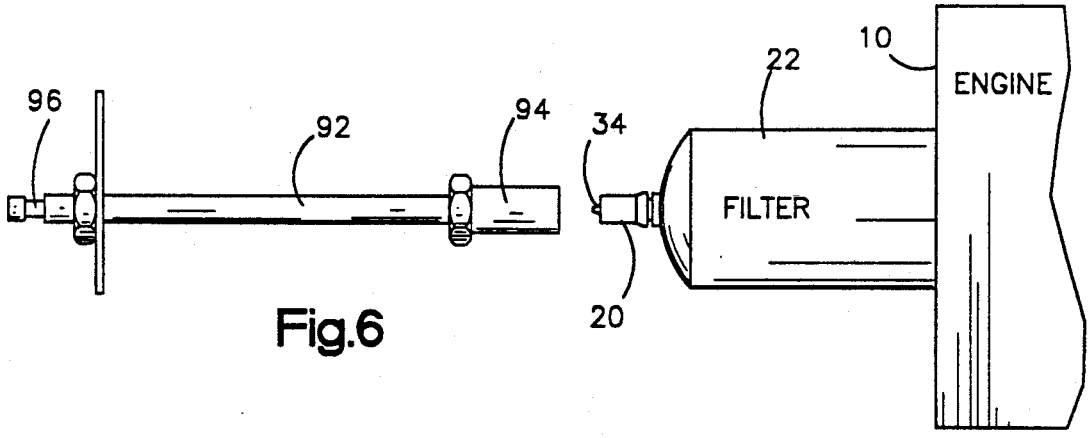
FIG. 6 is a schematic representation of an auxiliary hose for use with filters at hard-to-reach locations.

In some vehicles, access to the fitting 20 will be difficult to achieve because of the positioning of the filter 22 relative to other vehicle components. In that event, it may be desirable to install an auxiliary hose 92 as shown in FIG. 6. The hose may be mounted, for example, on a fender well with an outlet female fitting 94 positioned in proximity to the fitting 20. In certain installations, it may be desirable to have the male fitting portion 64, other than coaxial with, the mounting element 30 such as by providing a 90° or 45° elbow. When new oil is to be added, the female fitting 94 is connected to the filter fitting 20 while the female fitting 62 connected to the hose 68 is connected to a male fitting 96 at the end of the auxiliary hose 92 remote from the female fitting 94 and the filter 22. The male fitting 96 can be, if desired, permanently mounted to the fender well, as we have indicated. In that event, the fitting 96 will be positioned for easy and ready access.

Another embodiment of the invention has the fill fitting 20 permanently attached to the oil filter 22 through a process such as brazing or welding.

So long as replacement oil is introduced to the engine 10 in the high-pressure side 16 of the conduit 14, there is a high degree of likelihood the oil filter unit 22 will be initially filled with replacement oil and that, upon restarting the engine, replacement oil will quite promptly be supplied to the engine parts requiring lubrication. The fill fitting 20 can thus be placed to introduce replacement oil anywhere along the high-pressure side 16 of the conduit 20. When replacement oil is so introduced, it flows into the high-pressure side filling the oil filter unit 22 and the line between the filter and the pump outlet. While the fill fitting can be located anywhere along the high-pressure side, it is preferable that replacement oil be introduced between the pump 12 and the filter unit 22 so that the replacement oil passes through the filter 22 before being initially circulated through the lubrication system.

FIGS. 8–11 illustrate an example of such a system which forms another embodiment of the invention. In this embodiment, the fill fitting 20 is located between the oil pump discharge and the filter inlet so that the lubrication system is immediately supplied with filtered replacement oil when the engine first starts after the oil change. Furthermore, the FIGS. 8–11 embodiment permits the use of conventional prior art-type oil filter units with engines which need not be modified themselves to employ the benefits of the invention.

Referring to FIG. 8–11, it will be seen that an adapter in the form of a loading ring 98 is detachably mounted on the engine 10 between the engine block and a conventional oil filter unit 22, and that a fill fitting 20 constructed according to the invention is supported by the loading ring 98 so the lubrication system can be filled with replacement oil via the fill fitting and the loading ring.

The loading ring 98 comprises a disc-like body 100, an engine mounting adapter tube 102 attached to the body 100 and effective to detachably secure the body to the engine, and seals 104 for assuring oil tight connections between the engine, the loading ring and the filter unit. The loading ring 98 is constructed and arranged so that it directs oil from the pump outlet into the filter inlet after which the oil flows through the filter element and to the engine parts via the adapter tube 102. The loading ring receives and supports the fill fitting 20 and communicates the fill fitting with the filter inlet 34 so that replacement oil is introduced into the engine through the filter element.

The loading ring body 98 is a generally cylindrical flat disc-like member having planar side faces 106, 108, a central through bore 110 extending along the ring axis between the faces, and an array of circumferentially extending slots 112 disposed about the bore 110 each extending axially completely through the ring. The opposite ends of each slot open into respective ring faces and communicate with the filter inlet openings.

The adapter tube 102 has a smooth central tube body section 114 engaging the loading ring and snugly mounted in the bore 110 and oppositely projecting threaded ends 116, 118 for connection to the engine and the filter unit, respectively. The end 116 is threaded into a nipple in the engine oil conduit 14 leading from the filter unit to the engine parts to be lubricated. The filter unit 22 is screwed onto the end 118 with the filter outlet opening into the adapter tube. The central tube body is provided with a flange 120 disposed about the tube between the central tube body section 114 and the end 116. The flange has wrench flats formed on it and engages the loading ring body when the ring body is tightly threaded onto the engine to clamp the ring body to the engine.

The ring body faces 106, 108 each carry an annular seal element 104. When the ring body is installed the seals 104 seal against the filter unit base and the engine block, respectively, to prevent the oil being delivered to the filter unit inlet from leaking from the system around the loading ring. Oil thus flows from the pump outlet into the filter unit inlet through the loading ring slots 112.

Figure 10:
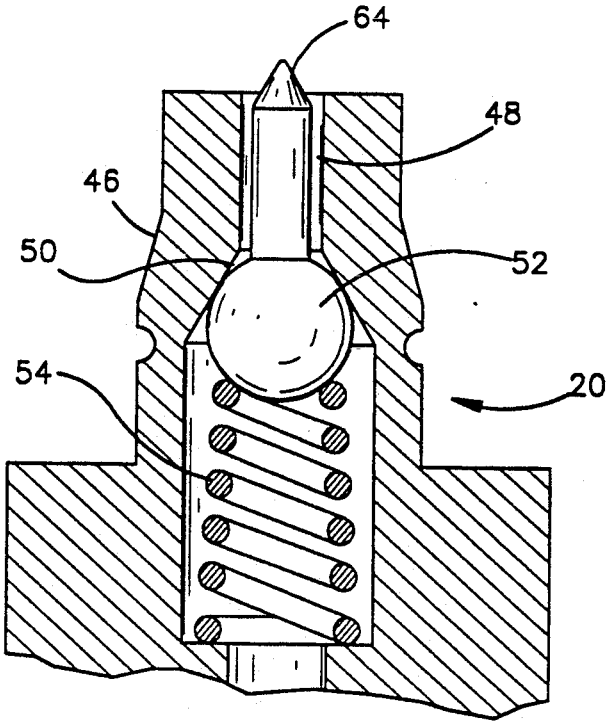

The fill fitting 20 is supported by the loading ring body in communication with the filter unit inlet so that replacement oil introduced to the system passes through the filter unit before being circulated to the engine. The fill fitting 20 is disposed in a radially extending loading ring body hole 122 drilled through the cylindrical outside wall of the ring body to one of the slots 112. The illustrated hole 122 is tapped and the fill fitting is screwed into it. The fill fitting 20 is illustrated by FIGS. 2 and 10 as comprising an elongated cylindrical supporting body 46 having a threaded end portion extending into the loading ring hole 122, a central oil receiving fill passage 48 extending through the body, a valve seat 50 in the fill passage, a check valving member 52 and a biasing spring 54 for biasing the valving member into sealing engagement with the seat to normally close the fill passage. The valving member illustrated in FIG. 11 is a one piece member which projects from an opening in the end of the fill fitting for engagement and depression by an oil delivery pneumatic hose when the engine oil is to be replaced. The projecting end portion of the fill fitting is, like the fill fitting 20 described above, constructed to coact with the pneumatic hose when the lubrication system is being refilled.

Although the preferred embodiments of the present invention have been illustrated and described, the present invention is not to be considered limited to the precise embodiments disclosed. Various adaptations, modifications and uses of the invention may occur to those skilled in the art to which the invention relates and the intention is to cover all such adaptations, modifications and uses which fall within the spirit or scope of the appended claims.

I claim:

1. An engine lubrication system comprising a pump and an oil conduit means defining a first pressure side for delivering oil from an outlet of the pump to engine parts and a second lower pressure side for returning oil from the engine parts to the pump, the conduit means comprising:

a. an oil filter unit having an inlet communicating with the pump outlet, the pump outlet being for discharging oil into a passage communicating with engine parts to be lubricated and the filter unit through which the oil passes; and, b. a fill fitting in fluid communication with said first pressure side for use during an oil change process through said passage for directing replacement oil into said first pressure side for supplying new oil to the oil filter unit, said fitting comprising:

i. a fitting body;

ii. a fill passage extending through the body;

iii. a check valve member located in the fill passage;

iv. a valve seat located in the fill passage; and, v. biasing means for biasing the check valving member against the valve seat.

2. The lubrication system of claim 1 wherein said fill fitting is connected to said oil filter unit communicating with said fill passage.

3. The lubrication system of claim 2 wherein said fill fitting further comprises a threaded base threaded into said oil filter unit.

4. The lubrication system of claim 1 wherein said fill fitting further includes a loading ring mounted to said engine and said filter is mounted to said filter unit at a filter mounting end.

5. A method of changing an engine's used oil during an oil change process comprising:

a. draining substantially all used oil from an engine;

b. removing a used oil filter unit from an engine;

c. mounting a new oil filter unit to the engine in place of the used oil filter unit;

d. filling the new oil filter unit by supplying new oil to the filter unit by flowing oil through a check valve equipped fill fitting located along and in direct communication with a pressure side of an oil supply conduit, the pressure side of the supply conduit originating at an oil pump and ending at parts of said engine to be lubricated.

6. An engine conduit system for providing lubrication to parts of an internal combustion engine to be lubricated comprising:

a. a pressure side originating at a pump and terminating at said engine parts, said pressure side including an oil filter unit intermediate said pump and engine parts;

b. a second side originating at said engine parts and terminating at said pump; and, c. a loading fitting adapted to receive replacement oil during an oil change process in order to supply the oil filter unit with replacement oil, said loading fitting being located along and in direct fluid communication with said pressure side, said fitting including a check valve means for preventing oil from exiting the fitting.

7. The conduit of claim 6 wherein said fitting is located on said oil filter unit.

8. The conduit of claim 7 wherein said fitting is removably connected to said oil filter unit.

9. The conduit of claim 6 further including a mounting plate adapted to be mounted to the filter unit at a filter mounting end, wherein the plate is capable of being mounted to the engine, and wherein the loading fitting is located on the mounting plate.

10. A method of changing an engine's used oil from such engine's lubrication system during an oil change process comprising:

a. draining substantially all used oil from an engine;

b. removing a used oil filter unit from an engine;

c. mounting a new oil filter unit to the engine in place of the used oil filter unit;

d. filling the new oil filter unit as new oil is supplied to the engine, the filter being supplied by supplying new oil to the filter unit by flowing oil through a check valve equipped fitting connected to the engine's lubrication system on the pressure side of an oil pump of said engine.

* * * * *